US006450791B1

(12) United States Patent
Kawabata et al.

(10) Patent No.: US 6,450,791 B1
(45) Date of Patent: Sep. 17, 2002

(54) SCROLL COMPRESSOR

(75) Inventors: Natsuki Kawabata; Kazuaki Shiinoki; Masakazu Aoki, all of Shimizu; Shigeru Machida, Iwama; Toshiaki Yabe, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/908,843

(22) Filed: Jul. 20, 2001

(51) Int. Cl.[7] ..... F01C 1/02

(52) U.S. Cl. ..... 418/55.1; 418/55.2; 418/55.4; 417/572

(58) Field of Search ..... 418/55.4, 55.2, 418/55.1; 417/572, 410.5

(56) References Cited

U.S. PATENT DOCUMENTS 5,556,269 A * 9/1996 Suzuki et al. ..... 418/55.2
5,690,480 A * 11/1997 Suzuki et al. ..... 418/55.2
5,755,564 A * 5/1998 Machida et al. ..... 418/101
6,123,529 A * 9/2000 Kawano et al. ..... 418/55.2

FOREIGN PATENT DOCUMENTS

| | | | |
|---|---|---|---|
| JP | 50-033924 | * | 2/1975 |
| JP | 10-246189 | | 9/1998 |
| JP | 10-252668 | | 9/1998 |

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

In a double toothed type scroll compressor, spiral wraps are formed on both sides of an end plate of an orbiting scroll, and wraps adapted to engage with the spiral wraps are formed on a stationary scroll. A dust wrap is formed on a side diametrically outside of the wrap of the stationary scroll. Grooves are formed on ends of the respective wraps to receive therein seal members formed of a high polymer material. Electric charge of static electricity produced when the seal members slide on surfaces of the mating end plate is made to flow from a bolt provided on an end of a crankshaft to the stationary scroll through a brush, thereby preventing accumulation of electric charge in a crankshaft.

20 Claims, 8 Drawing Sheets

SCROLL COMPRESSOR

BACKGROUND OF THE INVENTION

The present invention relates to a scroll compressor having spiral type scroll wraps, and more particularly, to a double toothed type oil-free scroll compressor suitable for use in air compressors.

Conventionally, scroll compressor have been used for refrigeration and air conditioning, which comprise a stationary scroll having a spiral wrap provided upright on an end plate and an orbiting scroll having a wrap adapted to engage with the wrap of the stationary scroll. In recent years, such scroll compressors have also been used as an air compressor because of their advantageous low noise.

Incidentally, convenience in use has increased a demand for scroll compressors for air compression, which range from a low air volume type for painting or the like to a high air volume type for a factory air source or the like. In order to meet a demand for high air volumes, a so-called double toothed type scroll compressor having an orbiting scroll with wraps on both sides of an end plate has gotten in the spotlight. An example of such double toothed type scroll compressor is described in Japanese Patent Laid-Open Nos. 10-246189 and 10-252668.

A scroll compressor, being one type of displacement type compressors, must be formed with an enclosed space. In particular, in the case of an oil-free compressor, any seal based on an oil film is not provided, and so an elastic member called a tip seal is disposed as a seal member between a tip end of a scroll wrap and an end plate, which the scroll wrap faces. It is required that such tip seal be excellent in sealing quality and low in friction. Therefore, a high polymer material such as a fluorine contained resin is often used for the tip seal.

It has proved from experimental studies conducted by the inventors of the present application that the use of a resin material for the tip seal may possibly cause the following disadvantage. That is, scroll compressors, in particular, oil-free scroll compressors for air compression, use grease-filled bearings for supporting a crankshaft. In operation, oil films of the bearing make electrical insulation between the crankshaft and a stationary scroll and between the crankshaft and an orbiting scroll. Both orbiting and stationary scroll members are formed by coating an aluminum alloy stock with an alumite film, which is an insulator to make electrical insulation between the orbiting scroll and the stationary scroll.

In ordinary use, the compressor is used in a state in which the stationary scroll is grounded. Meanwhile, the orbiting scroll and the crankshaft are not grounded. When the compressor is started in this state, static electricity is produced by sliding of the tip seal on the end plate surface of the scroll member or by sliding of a belt on pulleys, and has its electric charge accumulated in the crankshaft and orbiting scroll. While an accumulating amount of electric charge is not so much for a low capacity compressor, it increases remarkably with an increase in compressor capacity. Such electric charge generates an electric potential difference between inner and outer races of a roll bearing, and thus hydrogen ions induced accumulate in a location of high stresses within the bearing. The accumulated hydrogen ions change the internal structure of a bearing steel to create crack inside of the bearing steel. In the worst case, the roll bearing may be damaged electrically.

BRIEF SUMMARY OF THE INVENTION

The present invention has been devised to solve the above-mentioned disadvantages involved in the prior art, and has its object to operate a scroll compressor over a long term with high reliability.

To attain the above object, a scroll compressor according to the present invention comprises an orbiting scroll having a spiral wrap; a stationary scroll having a spiral wrap adapted to engage with the wrap of said orbiting scroll; a crankshaft for driving said orbiting scroll; and a tip seal mounted on a tip end of the wrap of at least one of said stationary scroll and said orbiting scroll, and wherein at least one of said orbiting scroll and said crankshaft is formed of an electrically conductive material, and further comprises a conducting means for providing electrical conduction of said orbiting scroll to said stationary scroll in operation of said scroll compressor.

To attain the above object, another scroll compressor according to the present invention comprises an orbiting scroll having a spiral wrap; a stationary scroll having a spiral wrap adapted to engage with the wrap of said orbiting scroll; a crankshaft for driving said orbiting scroll; and a tip seal mounted on a tip end of the wrap of at least one of said stationary scroll and said orbiting scroll, and wherein at least one of said orbiting scroll and said crankshaft is subjected to insulator or nonconductor coating surface treatment, and further comprises a conducting means for providing electrical conduction of said orbiting scroll to said stationary scroll in operation of said scroll compressor.

In any one of the above-described scroll compressors, a slip ring or a brush may be provided on an end of said crankshaft to conduct static electricity accumulated in said crankshaft to the outside of said crankshaft; and said tip seal may be formed of an electrically conductive material, and a surface of said orbiting scroll or said stationary scroll, with which said tip seal contacts, may be made electrically conductive. Further, it is desired that an annular dust wrap is provided on a side diametrically outside of the wrap of said stationary scroll, and a conductive dust seal is disposed on a tip end of said dust wrap.

Further, in any one of the above-described scroll compressors, a roll bearing may be provided for supporting the crankshaft, of which inner and outer races are electrically connected to each other in operation; the roll bearing may contain an electrically conductive grease; a roll bearing may be provided for supporting the crankshaft, and wherein at least one of inner and outer races, and rolling elements of the roll bearing may be formed of an electrical insulator; and a roll bearing may be provided for supporting the crankshaft, and at least one of inner and outer races, and rolling elements of the roll bearing may be formed of a material, which forms a nonconductor film. In addition, the material forming a nonconductor film may be a martensitic stainless steel.

To attain the above object, any one of the above-described scroll compressors may be an oil-free compressor, the orbiting scroll may have spiral wraps on both sides of an end plate, the stationary scroll may comprise a pair of stationary scroll members each having a wrap adapted to engage with each of the wraps of the orbiting scroll, and working chambers defined by the wraps of the orbiting scroll and the stationary scroll may be free of entry of an oil such as lubricant or the like.

To attain the above object, a still another scroll compressor according to the present invention comprises an orbiting scroll having a wrap; a stationary scroll having a wrap adapted to engage with the wrap of the orbiting scroll; a crankshaft and an auxiliary crankshaft disposed on a side diametrically outside of the wraps of both the orbiting scroll and the stationary scroll and for driving the orbiting scroll;

a first pulley mounted on the crankshaft and a second pulley mounted on the auxiliary crankshaft; and a belt trained around outer peripheral sides of the first and second pulleys; and the belt is electrically connected to the first and second pulleys.

To attain the above object, a still further scroll compressor according to the present invention comprises an orbiting scroll having a wrap; a stationary scroll having a wrap adapted to engage with the wrap of the orbiting scroll; a crankshaft and an auxiliary crankshaft for driving the orbiting scroll and disposed on a side diametrically outside of the wraps of both the orbiting scroll and the stationary scroll; a first pulley mounted on the crankshaft and a second pulley mounted on the auxiliary crankshaft; and a belt trained around outer peripheral sides of the first and second pulleys; and electrical insulation is made between the crankshaft and the first pulley and between the auxiliary crankshaft and the second pulley.

To attain the above object, a further scroll compressor according to the present invention comprises an orbiting scroll having spiral wraps on both sides of an end plate; a pair of stationary scrolls having wraps adapted to engage with the wraps of the orbiting scroll; a main crankshaft and an auxiliary crankshaft for rotationally driving the orbiting scroll, and disposed on a side diametrically outside of the wraps of both the orbiting scroll and the stationary scrolls; a plurality of roll bearings for supporting the main crankshaft and the auxiliary crankshaft; first and second pulleys mounted on the main crankshaft and auxiliary crankshaft, respectively; a resin belt trained around the first and second pulleys; resin tip seals held in grooves formed on tip ends of the orbiting scroll wraps and the stationary scroll wraps; and static electricity discharging means provided to discharge static electricity, which is produced in the timing belt portion and the tip seal portions, from the orbiting scroll to the stationary scrolls.

In the above-described scroll compressor, the static electricity discharge means may be a slip ring provided on an end of at least one of the main crankshaft and the auxiliary crankshaft; and the static electricity discharge means may comprise an electrically conductive grease for preventing the accumulation of static electricity in the roll bearings. Also, it is desired that the bearings comprise grease-lubricated bearings, and a base oil of the grease is an ether-based synthetic oil and a thicker therefor is a urea compound.

That is, in an oil-free scroll compressor, at least one of the orbiting scroll and the crankshaft may be brought into contact with the stationary scroll or other grounding members via an electrically conductive member to maintain the orbiting scroll, crankshaft, and the stationary scroll in the same electric potential; or electrical damages on the bearings may be prevented by arranging an insulator or the like even when electric potential difference is present between the orbiting scroll, stationary scroll, and the crankshaft.

DETAILED DESCRIPTION OF THE INVENTION

Several embodiments of the present invention will now be described with reference to the accompanying drawings.

Figure 1:
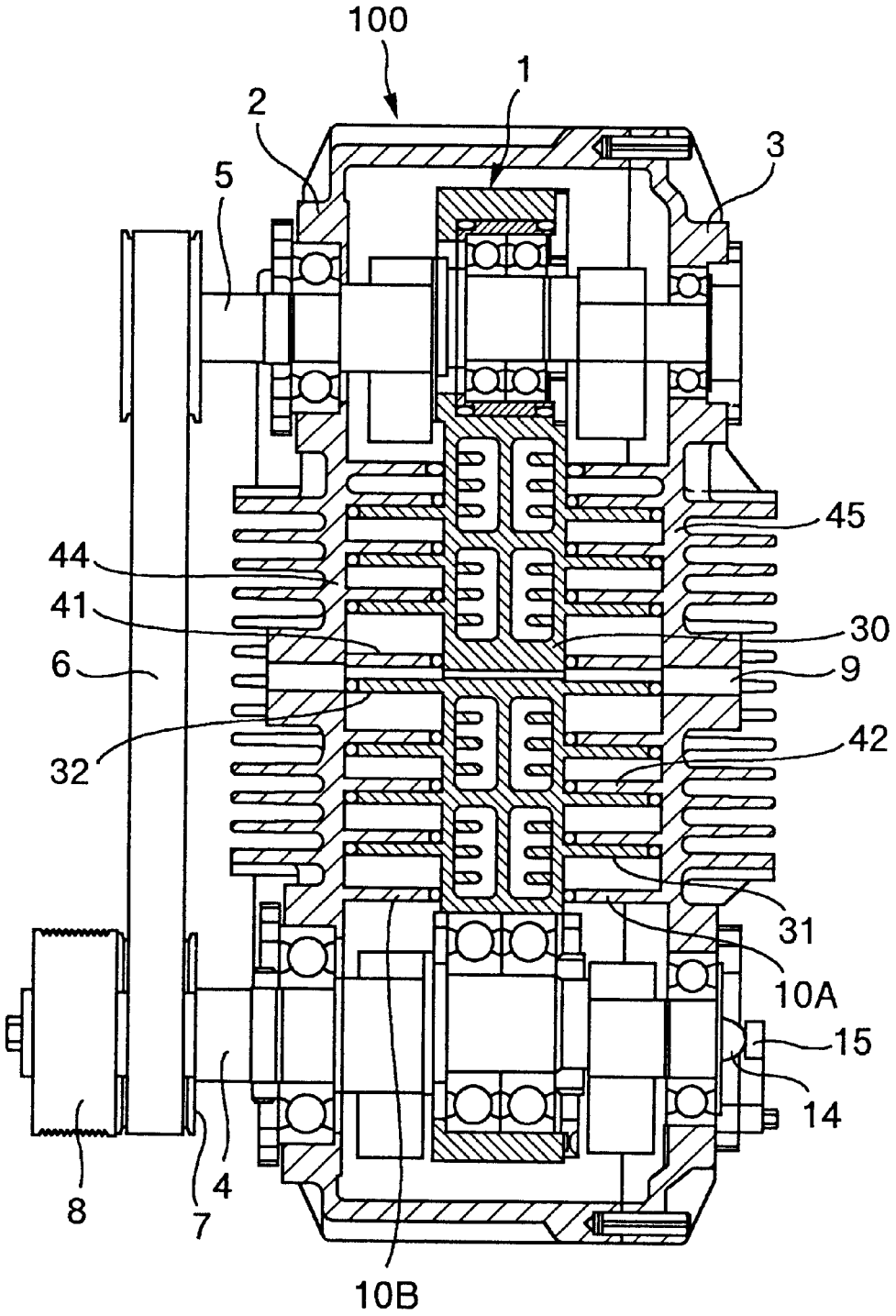
FIG. 1 is a longitudinal sectional view showing one embodiment of a scroll compressor according to the present invention.
Figure 13:
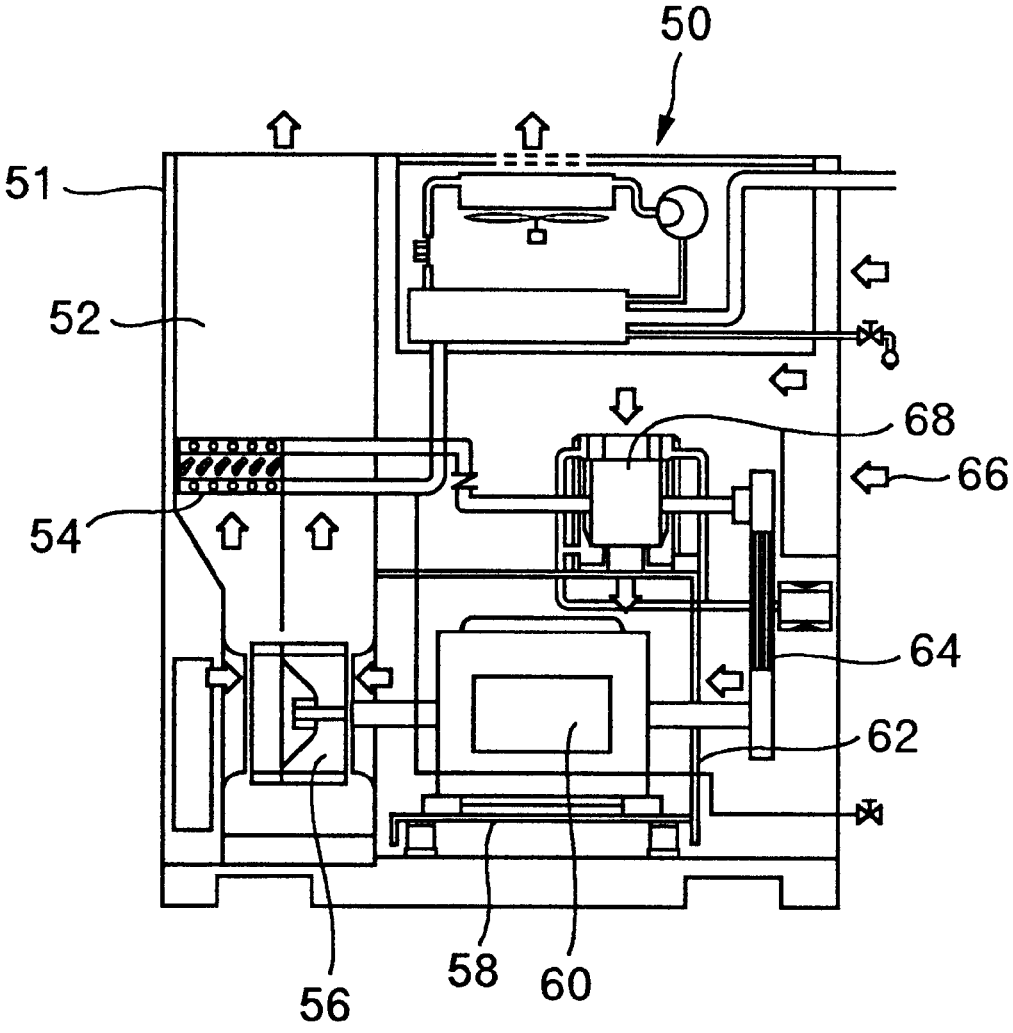
FIG. 13 is a partial sectional view of a compressor unit in which a scroll compressor according to the present invention is mounted.

FIG. 1 is a longitudinal sectional view showing a body block of a so-called double toothed type scroll compressor, in which wraps are formed on both sides of an end plate of an orbiting scroll. The compressor of this type is mainly used for air compression as schematically shown in FIG. 13. In FIG. 13, with a compressor unit 50, a motor 60 is installed on a base provided at a bottom of a housing 51. Driving force of the motor 60 is transmitted to a scroll compressor 68 by a belt 64 trained around a pulley mounted on a rotating shaft of the motor 60. The scroll compressor 68 has its leg portions supported on a compressor support member 62 provided in the housing 51. A fan 56 for cooling the motor 60, the scroll compressor 68, and a compressed air having been compressed by the scroll compressor is mounted on an end of the rotating shaft of the motor 60 opposite to a side where the pulley is installed. When the motor 60 is rotated, an air surrounding the compressor unit 50 is caused to flow through an intake port formed in the housing 51 in a direction indicated by arrow 66 to be introduced to a suction side of the fan 56, thus cooling a heat exchanger 54 disposed in a duct 52 formed on a discharge side of the fan 56.

In FIG. 1, a double toothed type scroll compressor 100 comprises an orbiting scroll 1 having spiral scroll wraps 31 and 32 formed on both surfaces of an end plate 30, a stationary scroll 2 (left-hand side in FIG. 1) and a stationary scroll 3 (right-hand side in FIG. 1) having spiral scroll wraps 41, 42 formed on end plates 44, 45 and adapted to engage with the wraps 32, 32 of the orbiting scroll 1 to define a compression chamber, a main crankshaft 4 for driving the orbiting scroll 1, an auxiliary crankshaft 5 rotated in synchronization with the main crankshaft 4, a timing belt 6 for making the auxiliary crankshaft 5 and the main crankshaft 4 in synchronism with each other, a timing pulley 7 around which the timing belt 6 is trained, and a V pulley 8 for use in transmitting the power of a motor (not shown), which drives the main crankshaft 4, to the main crankshaft 4. A discharge port 9 is formed substantially centrally of the stationary scroll 3 to allow discharge of the compressed air therethrough.

The double toothed type scroll compressor constructed as described above operates in the following manner. Power generated by the motor is transmitted to the V pulley 8 through a V belt. Thereby, the main crankshaft 4 is rotated, and the power is transmitted to the auxiliary crankshaft 5 through the timing belt 6 and the timing pulley 7 for synchronization to rotate the auxiliary crankshaft 5 in synchronism with the main crankshaft 4. When both the crankshafts 4 and 5 are rotated synchronously, the orbiting scroll 1 moves eccentrically relative to both the stationary scrolls 2 and 3 without rotation on its axis. A fluid is sucked through a suction port (not shown) to be compressed as the orbiting motion of the orbiting scroll 1 proceeds, and is then discharged through the discharge port 9. In addition, in order to prevent dust from entering into the compression chamber, ring-shaped dust wraps 10A and 10B are formed on outer-diameter sides of both the wraps 41 and 42 of the stationary scroll 1.

Figure 2:
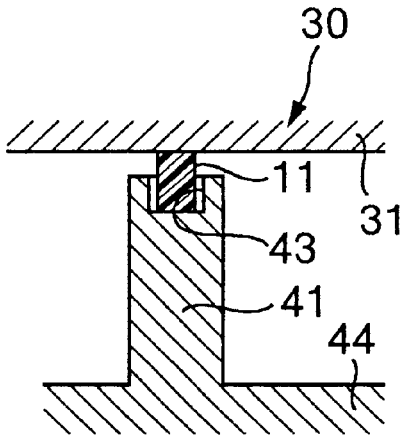
FIG. 2 is a detailed sectional view of a tip seal portion used for the scroll compressor shown in FIG. 1.

FIG. 2 shows a detailed cross section of the stationary scroll wrap. The stationary scroll on the left-hand side in FIG. 1 is taken as an example. A groove 43 is formed at a tip end of the wrap 41 of the stationary scroll 2 to extend in a spiral direction, and a tip seal 11 is loosely fitted in the groove 43. The tip seal 11 serves to prevent the compressed gas in the compression chamber from leaking in the spiral direction of the wrap 41 and in a radial direction (from a central portion to an outer peripheral side) of the orbiting scroll 1. The tip seal 11 is disposed at a wrap tip end of at least one of the orbiting scroll 1 and the stationary scrolls 2, 3. In operation, the tip seal slides on the end plate surface of a scroll member opposite to that scroll member, on which the tip seal is disposed.

Figure 3:
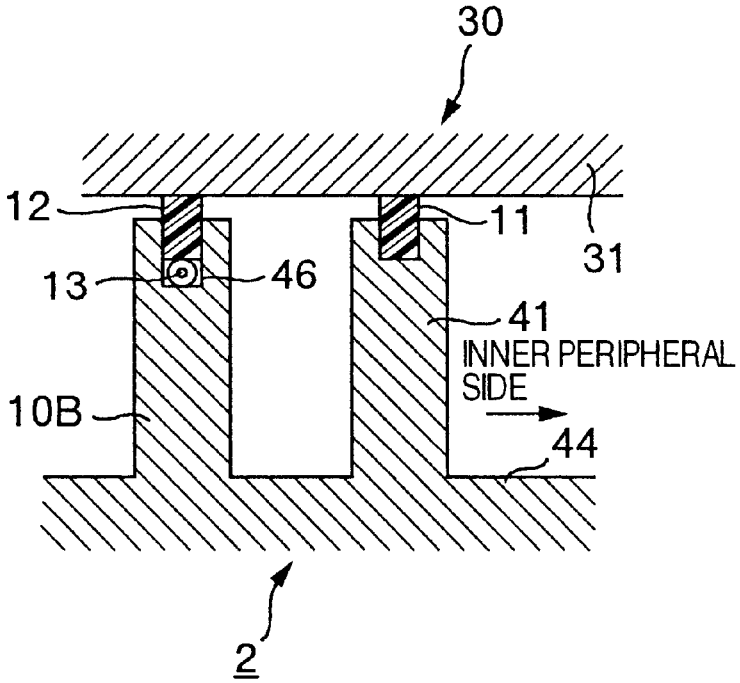
FIG. 3 is a detailed sectional view of a dust seal portion used for the scroll compressor shown in FIG. 1.

FIG. 3 shows a detailed cross section of the dust wrap 10B formed on the stationary scroll 2 on the left-hand side in FIG. 1. The dust wrap 10B is formed on an outer periphery side of the wrap 41 of the stationary scroll 2. A groove 46 is circumferentially formed on an end of the dust wrap 10B opposite to the end plate 44 surface. A dust seal 12 is housed in the groove 46 in a manner to be pushed up by a backup tube 13. When the orbiting scroll 1 is assembled to the stationary scroll 2, elasticity of the backup tube 13 and the dust seal 12 brings the dust seal 12 into close contact with the end plate 30 surface of the orbiting scroll 1 to prevent dust from entering into the compression chamber.

In addition, in terms of sliding property, heat resistance and elasticity, a high polymer material containing a tetrafluoroethylene resin is used to form the dust seal and the tip seal. The dust seal and the tip seal generate heat due to their sliding motions. Therefore, when heat resistance is further desired, a heat resistant resin such as polyimide resins may be used.

Since the tip seal and the dust seal are formed mainly of a high polymer material as described above, static electricity is produced when they slide on the end plate surface of the mating scroll member. In the case where no lubricant is introduced into the compression chamber especially as in the case of air compressors, or in the case where nonconductor coating treatment is applied, such static electricity is liable to accumulate in the member, in which it is produced.

Also, the pulleys mounted on the crankshaft and the auxiliary crankshaft and the timing belt trained around the pulleys transmit power while slipping slightly in ordinary operation. A material composed mainly of a resin. material is used as a material for the belt to ensure flexibility. As a result, static electricity will be produced in the pulley portions.

Incidentally, with the scroll compressor according to the present invention, the orbiting scroll housed in a cover constituted by the stationary scroll is rotationally driven by the crankshaft and the auxiliary crankshaft, so that static electricity will accumulate unless a conduction path is secured between the crankshaft or the auxiliary crankshaft and the orbiting scroll or the stationary scroll. Thereupon, the inventors have pushed forward experimental studies on influences of static electricity on the scroll compressor.

The studies have revealed that whether a difference in electric potential is great or small, static electricity has less influence on equipments provided that a discharge path is secured. If an insulating portion is present in the discharge path, however, the insulating portion is charged with electricity. If the insulating portion is disposed on a roll bearing, both inner and outer races of the roll bearing, respectively, are charged with electricity when the scroll compressor is operated. As a result, there has been obtained a knowledge that an electric potential difference is produced between the inner and outer races.

Furthermore, when an electric potential difference was produced between the inner and outer races of the roll bearing, a bearing damage pattern that has not been reported before was obtained. Even if static electricity was produced, such a damage pattern was not obtained merely by slippage of a belt, for example, in the case of a motor.

Fatigue failure caused by a cyclic stress is most common as a damage pattern of a roll bearing, and the nominal service life of the bearing is determined based on such fatigue failure. When a roll bearing is damaged due to rolling fatigue, various structural changes generate in the bearing. A typical damage is one caused near a location where a maximum shearing stress acts, such as stripes generated in a specific direction and crack developing from impurities present near a location where the maximum shearing stress acts. In addition to such damage caused by fatigue failure, there is the possibility of electrolytic corrosion if an electric potential difference is produced between inner and outer races of the bearing. Usually, if an electric potential difference caused electrolytic corrosion on the roll bearing, a pattern resembling a washboard would be developed on the rolling surface.

However, the damage pattern, in the present invention, caused by an electric potential difference of static electricity was a pattern different from any of the above-described patterns. Depending on experimental conditions, a service life in some cases decreased to about one tenth of the nominal service life (also referred to as L10 life) of a bearing based on rolling fatigue.

It has been inferred as a result of experiments as pushed forward that the following mechanism is responsible for such a damage pattern that has not been conventionally reported. An orbiting scroll, crankshaft, and an auxiliary crankshaft are charged with static electricity, which is produced when tip seals and dust seals mounted on wrap ends of the orbiting scroll and the stationary scroll slide on an end plate of a mating scroll or when a belt trained around pulleys mounted on the crankshaft and the auxiliary crankshaft makes slippage. Thus, electric potential differences generate between the orbiting scroll, crankshaft, auxiliary crankshaft, and the stationary scroll.

Grease being a lubricant for the roll bearings for bearing the crankshaft and the auxiliary crankshaft is decomposed into water by electric potential differences thus produced. As decomposition of the grease proceeds, hydrogen is generated from the grease. When the crankshaft and the auxiliary crankshaft are rotated, vibrations or the like produce incomplete portions in an oil film formed by the oil content in the grease, and hydrogen generated from such incomplete portions enters into the bearing steel. Such hydrogen accumulates near a location where a maximum shearing stress is caused in the rolling elements, inner and outer races of the bearing. The inventors of the present application have experimentally confirmed the above-described fact that hydrogen enters into the bearing steel.

In addition, the scroll compressor according to the present invention employs the timing belt and the belt for transmission of driving force of the motor, and so is liable to cause a so-called local contact phenomenon that load on bearings supporting the crankshaft and the auxiliary crankshaft is offset toward one side in a circumferential direction. As a result, excessive shearing forces are produced on the rolling elements of the roll bearing to make the oil film break with ease.

That is, the bearing is damaged under the influence of hydrogen generated from the water content contained in grease, such hydrogen entering into bearing parts such as the rolling elements, inner and outer races, and the like of the bearing to change the structure of a portion or portions, into which hydrogen enters. As a result, crack generates in the bearing parts, and exhibits itself as damages of the bearing when it reaches a surface or surfaces of the bearing parts. This phenomenon is quite different from the conventional phenomenon of electrolytic corrosion, and does take place before three factors of grease, a bearing load (including fluctuating loads) above some level, and electric potential difference of static electricity are all present.

Figure 4:
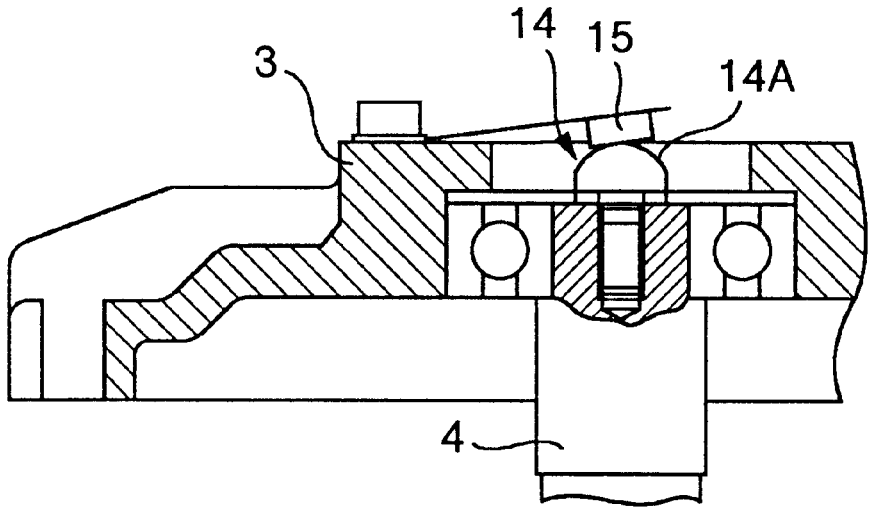
FIG. 4 is a detailed sectional view of a crankshaft end portion of the scroll compressor shown in FIG. 1.
Figure 5:
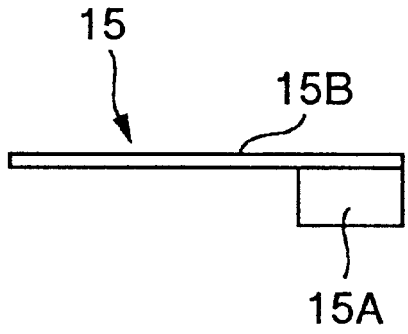
FIG. 5 is a front view of a brush used in the embodiment shown in FIG. 4.

Thereupon, the present invention provides static electricity removing means or electrical discharge means in order to prevent a bearing from being damaged by static electricity that may possibly be produced in a scroll compressor. Concrete examples therefor are shown in FIG. 4 and the following figures. FIG. 4 is a partial detailed sectional view of a crankshaft. In an embodiment shown in FIG. 4, the crankshaft 4 is grounded to the stationary scroll 3. A round head bolt 14 is mounted to a shaft end of the crankshaft 4. A brush 15, details of which are shown in FIG. 5, is mounted on an outer surface side of the stationary scroll 3 to be capable of coming in contact with a head 14A of the bolt 14 provided on the end of the crankshaft 4.

When the crankshaft 4 is rotated, electric charge of static electricity produced on the tip seals and the dust seals flows to the crankshaft 4. The electric charge then flows from the end of the crankshaft 4 to the bolt 14, and then to the stationary scroll 3 via the bolt head 14A and the brush 15. Thereby, it is possible to prevent accumulation of electric charge on the crankshaft 4. Preferably, the head 14A of the bolt 14 is of spherical shape so as to decrease the abrasion speed of the brush. For the simplicity of constitution, the bolt 14 may be omitted and the brush 15 may be brought into direct contact with the crankshaft 4. In this case as well, a spherical-shaped end of the shaft can reduce the contact resistance between the brush and the shaft end. While the brush is provided on the stationary scroll side in this embodiment, it may be provided on the crankshaft side.

The brush 15 is composed of a brush portion 15A and a plate portion 15B. The brush portion 15A is formed of a conductor such as metal, carbon, and electrically conductive resins. The brush portion 15A is desirably high in abrasion resistance because it slides on the bolt head 14A or the crankshaft end. An electric conductor of good elasticity such as phosphor bronze and stainless steel is used to form the plate portion 15B. Elasticity of the plate portion 15B makes it possible to push the brush portion 15A surely against the bolt head 14A or the crankshaft end. When electricity is removed with the use of the brush in this manner, the inner and outer races of the roll bearing are made identical to each other in electric potential, which can suppress decomposition of water content in the grease with an electric potential difference as energy.

Figure 6:
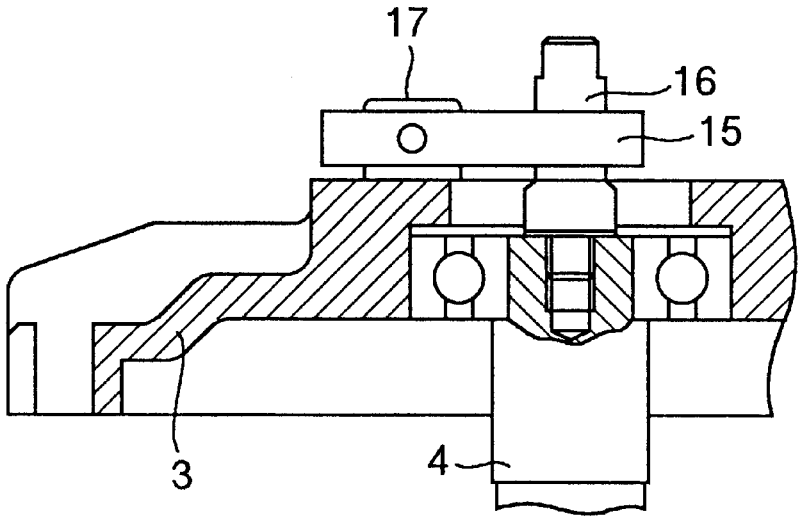
FIG. 6 is a detailed sectional view of a modification of a crankshaft end portion of the scroll compressor shown in FIG. 1.

Several modifications of the above-described embodiment, in which a brush is disposed on an end of a crankshaft and electric charge is allowed to flow to the stationary scroll via the brush, are shown in FIG. 6 and the following figures. An attachment 16 adapted to contact with a brush 15 is mounted on an end of the crankshaft 4. Meanwhile the stationary scroll 3 mounts thereon the brush 15 by way of an adapter 17. Contact of the brush 15 and the attachment 16 with each other can attain the same function and effect as those of the embodiment shown in FIG. 4.

Figure 7:
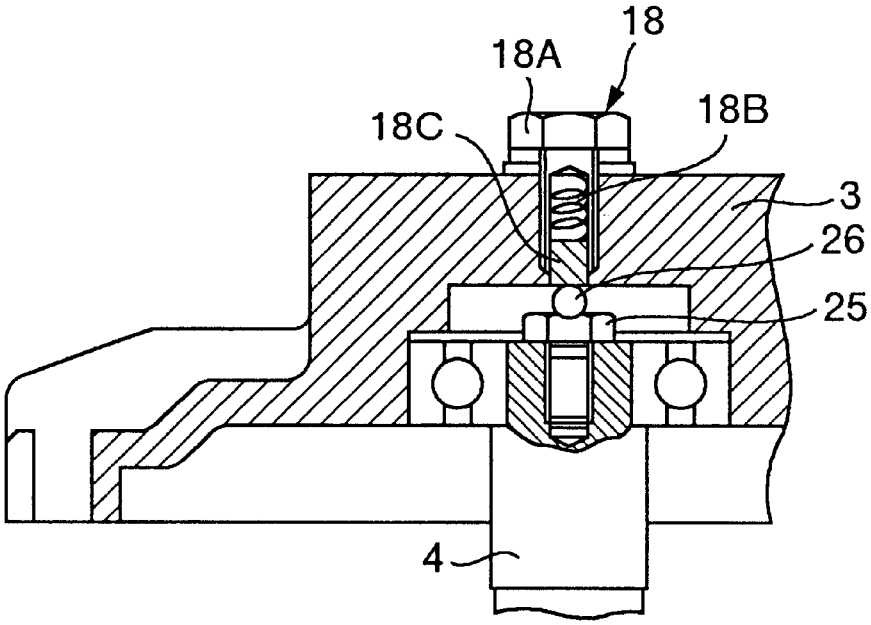
FIG. 7 is a detailed sectional view of another modification of a crankshaft end portion of the scroll compressor shown in FIG. 1.

With an arrangement shown in FIG. 7, a brush 18 is mounted on the stationary scroll 3 to be brought into contact with a bolt 25 mounted on an end of the crankshaft 4 or the crankshaft 4 itself or via a ball 26, thus permitting discharge of electric charge flowing to the crankshaft 4. In this modification, the brush 18 is composed of a hollow bolt 18A mounted on the stationary scroll 3, a brush portion 18C held in the bolt 18A, and a spring 18B held also in the hollow bolt. The brush portion 18C is subjected to a biasing force by the spring 18B. This modification has an advantage that a suitable biasing force is always applied to the brush portion by the spring.

Figure 8:
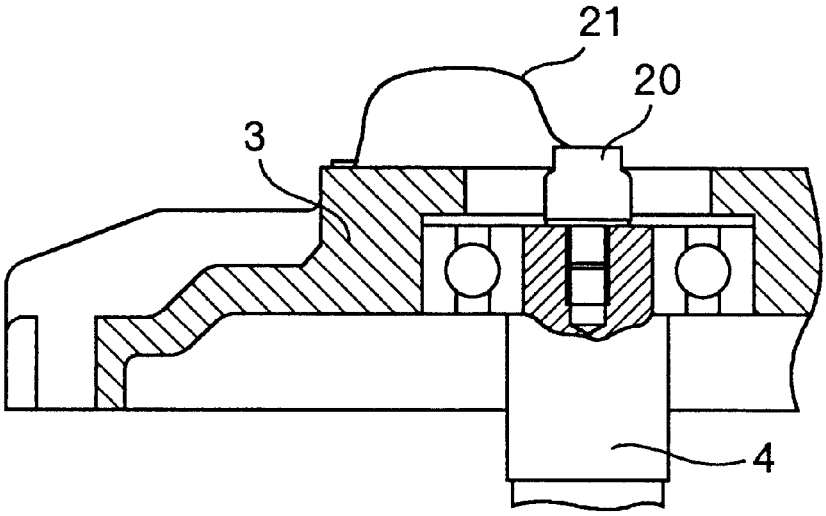
FIG. 8 is a detailed sectional view of still another modification of a crankshaft end portion of the scroll compressor shown in FIG. 1.

While in any one of the above-described modifications a brush is used to allow electric charge to flow from an end of the crankshaft to the stationary scroll, FIG. 8 shows an example of the use of a slip ring in place of the brush. FIG. 8 is a detailed cross sectional view of an end of the crankshaft. A slip ring 20 is mounted on the crankshaft 4, and is connected to the stationary scroll 3 with a conducting wire 21. In this case as well, the same effect as those of the above-described embodiment and modifications can be obtained.

Figure 9:
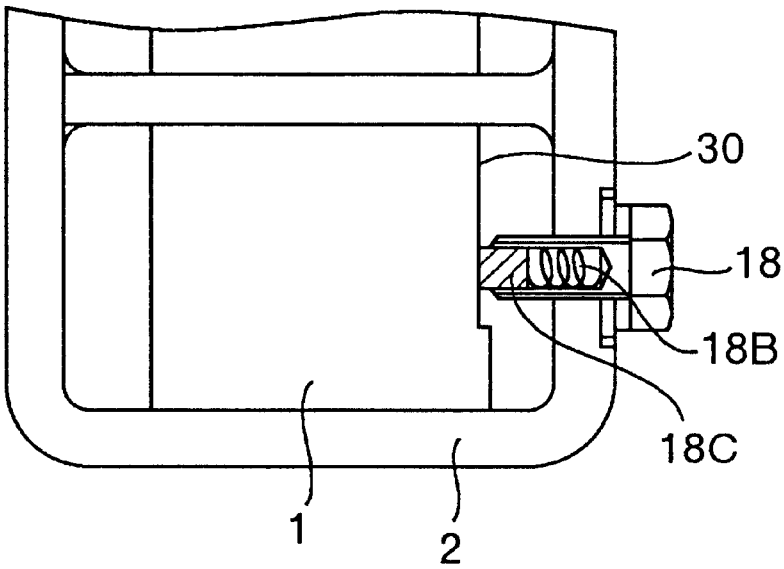
FIG. 9 is a detailed sectional view of an end portion of the scroll compressor shown in FIG. 1.
Figure 10:
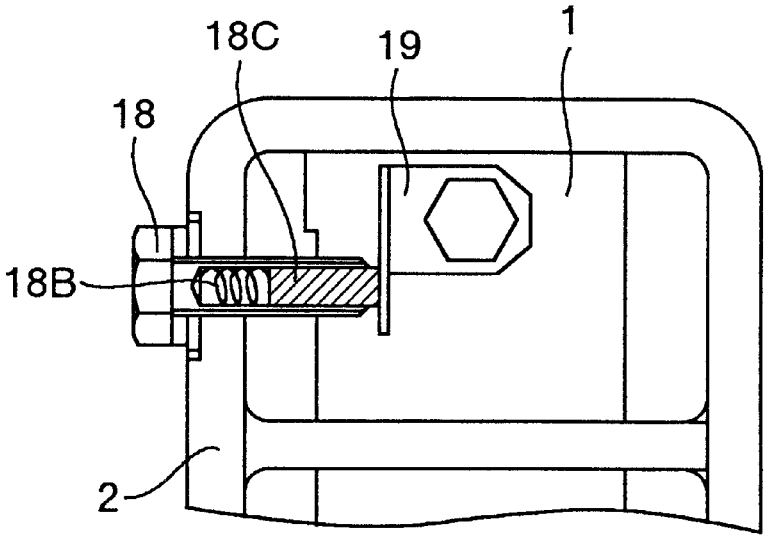
FIG. 10 is detailed sectional view of a modification of an end portion of the scroll compressor shown in FIG. 1.
Figure 11:
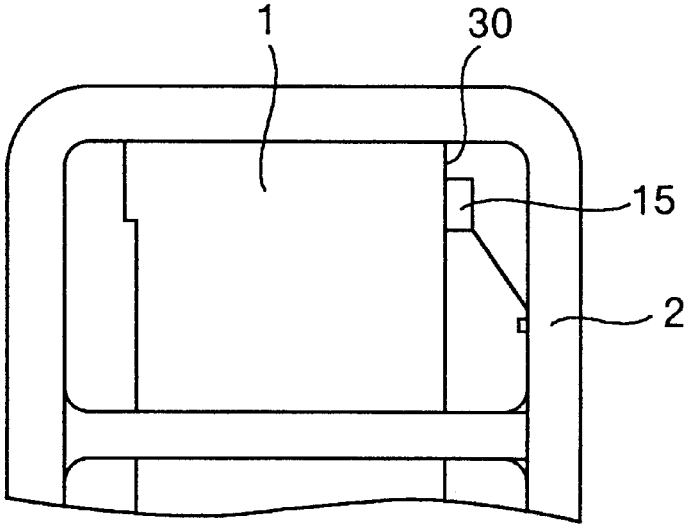
FIG. 11 is detailed sectional view of another modification of an end portion of the scroll compressor shown in FIG. 1.

FIGS. 9 to 11 inclusive show examples, in which the orbiting scroll 1 and the stationary scroll 2 are grounded to discharge static electricity produced by the tip seals and the dust seals. FIGS. 9 to 11 inclusive are partial, longitudinal cross sectional views showing a scroll compressor and an outer peripheral side portion of a wrap. In FIG. 9, a brush 18 mounted on the stationary scroll 2 is caused to slide on the surface of the end plate 30 of the orbiting scroll 1. Also, in FIG. 10, an electrically conductive plate 19 is mounted on the orbiting scroll 1 to permit the brush 18 to slide thereon. This modification has an advantage that mounting and dismounting of the brush are facilitated.

In FIG. 11, the same brush 15 as one shown in FIG. 5 is mounted on the stationary scroll 2 to slide on a surface of the end plate 30 of the orbiting scroll 1. In this modification as well, the same effect as those of the above-described embodiment and modification can be obtained. In addition, it goes without saying that the brush 15 may be mounted on the orbiting scroll 1 to slide on the surface of the end plate of the stationary scroll 2.

Incidentally, it has proved that static electricity generates at the tip seals and the dust seals, and so the tip seals 11 and the dust seals 12 are made to be formed of an electrically conductive material, and, a mating member, e.g. the stationary scroll is also formed of an electrically conductive material. Furthermore, in the case where surface treatment applied on the stationary scroll comprises an electrically conductive film, electric charge will not accumulate on the orbiting scroll 1, thus enabling avoiding any inconvenience caused by static electricity.

Figure 12:
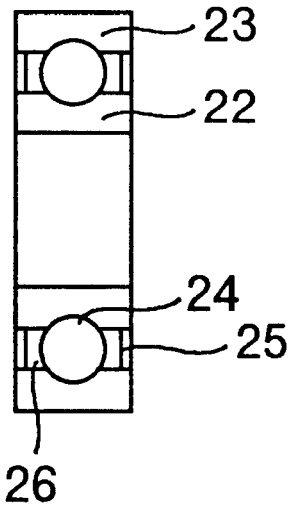
FIG. 12 is a sectional view of a bearing used in the scroll compressor shown in FIG. 1.

Also, electric charge of static electricity produced on the seal portions flows to the bearings disposed near the crankshaft. Therefore, a shield plate 25 of the roll bearing, shown in FIG. 12, for supporting the crankshaft is formed of an electrically conductive material to bring both of an inner race 22 and an outer race 23 into contact therewith. Thereby, at least one of the crankshaft 4 and the orbiting scroll 1 can be grounded. In addition, in FIG. 12, the roll bearing holds a grease 26 between the inner and outer races 22 and 23 and balls 24. When the grease 26 is made electrically conductive, at least one of the crankshaft 4 and the orbiting scroll 1 can also be grounded. Furthermore, when a base oil of the grease 26 is ether oil and the thickener thereof is urea, the oil film in operation becomes thicker to provide for the same effect as that of an insulating film such as oxide film, described later.

At least any one of the inner race 22, the outer race 23 and the balls 24 of the roll bearing for rotationally supporting the crankshaft is coated with an insulating film such as oxide film. Alternatively, these members are formed of a ceramic material or a stainless steel material coated with a nonconductive film. The reason for this is that even when static electricity is produced, the oxide film or the stainless steel material can restrain entry of hydrogen into the bearing steel and thus a change in the structure of the bearing steel.

Moreover, in the case where a driving surface of at least one of the V belt 64 for driving the V pulley 8, shown in FIG. 13, and the timing belt 6 is made electrically conductive, it is possible to suppress generation of electric charge. The V pulley is made an insulator to prevent electric charge produced by slippage between the belt and pulleys from flowing to the crankshaft side. Thereby, the bearing can be prevented from being damaged.

Possible causes for inconveniences in the bearings of the scroll compressor according to the present invention reside in existence of static electricity, hydrogen generated from decomposition of a water content contained in a grease, and possible breakage of a grease oil film, as described above. Therefore, most simply, generation of inconveniences on the bearings can be prevented by reducing an amount of the water content. This can be coped with by limiting the water content in the grease to 0.2% or less. Also, when a substance having high oxidation stability and thermal stability is chosen as a base oil of the grease and a substance having high heat resistance, waterproofness, and shear stability is chosen as a thickener of the grease, breakage of a grease oil film can be prevented to prolong the service life of the bearings. In this connection, it is desired that the base oil be an ester-based synthetic oil and the thickener be a urea compound.

While in any one of the above-described embodiments and modifications, static electricity collected in the orbiting scroll, crankshaft, and the auxiliary crankshaft is discharged or communicated to the stationary scroll, the same effect can also be obtained by discharging or communicating such static electricity to the compressor support member, on which the scroll compressor is mounted. Further, while an explanation has been given by way of a double toothed type scroll compressor, the present invention is not limited to such double toothed type scroll compressor but is applicable to all types of scroll compressors, in which static electricity presumably generates.

As described above, according to the present invention, static electricity produced by sliding of members, such as the seal members, the belt and the like, containing a resin material can be prevented from flowing to the bearing portions to damage the bearings, so that the scroll compressor can be operated over a long term with high reliability.

What is claimed is:

1. A scroll compressor comprising:

an orbiting scroll having a spiral wrap;

a stationary scroll having a spiral wrap adapted to engage with the wrap of said orbiting scroll;

a crankshaft for driving said orbiting scroll; and a tip seal mounted on a tip end of the wrap of at least one of said stationary scroll and said orbiting scroll, and wherein at least one of said orbiting scroll and said crankshaft is formed of an electrically conductive material, and further comprising a conducting means for providing electrical conduction of said orbiting scroll to said stationary scroll in operation of said scroll compressor.

2. The scroll compressor according to claim 1, wherein said conducting means comprises a slip ring or a brush provided on an end of said crankshaft to conduct static electricity accumulated in said crankshaft to the outside of said crankshaft.

3. The scroll compressor according to claim 1, wherein said tip seal is formed of an electrically conductive material, and a surface of said orbiting scroll or said stationary scroll, with which said tip seal contacts, is made electrically conductive.

4. The scroll compressor according to claim 1, wherein an annular dust wrap is provided on a side diametrically outside of the wrap of said stationary scroll, and a conductive dust seal is disposed on a tip end of said dust wrap.

5. The scroll compressor according to claim 1, further comprising a roll bearing for supporting said crankshaft, of which inner and outer races are electrically connected to each other in operation.

6. The scroll compressor according to claim 5, wherein said roll bearing contains an electrically conductive grease.

7. The scroll compressor according to claim 1, further comprising a roll bearing for supporting said crankshaft, and wherein at least one of inner and outer races, and rolling elements of said roll bearing is formed of an electrical insulator.

8. The scroll compressor according to claim 1, further comprising a roll bearing for supporting said crankshaft, and wherein at least one of inner and outer races, and rolling elements of said roll bearing is formed of a material, which forms a nonconductor film.

9. The scroll compressor according to claim 8, wherein said material forming a nonconductor film is a martensitic stainless steel.

10. The scroll compressor according to claim 1, wherein said scroll compressor is an oil-free compressor and wherein said orbiting scroll has spiral wraps on both sides of an end plate, said stationary scroll comprises a pair of stationary scroll members each having a wrap adapted to engage with each of the wraps of said orbiting scroll, and working chambers defined by the wraps of said orbiting scroll and said stationary scroll are free of entry of an oil.

11. A scroll compressor comprising:

an orbiting scroll having a spiral wrap;

a stationary scroll having a spiral wrap adapted to engage with the wrap of said orbiting scroll;

a crankshaft for driving said orbiting scroll; and a tip seal mounted on a tip end of the wrap of at least one of said stationary scroll and said orbiting scroll, and wherein at least one of said orbiting scroll and said crankshaft is subjected to insulator or nonconductor coating surface treatment, and further comprising a conducting means for providing electrical conduction of said orbiting scroll to said stationary scroll in operation of said scroll compressor.

12. The scroll compressor according to claim 11, wherein said tip seal is formed of an electrically conductive material, and that surface of said orbiting scroll or stationary scroll, with which said tip seal contacts, is electrically conductive.

13. The scroll compressor according to claim 11, further comprising an annular dust wrap provided on a side diametrically outside of the wrap of said stationary scroll, and an electrically conductive dust seal arranged on a tip end of said dust wrap.

14. The scroll compressor according to claim 11, further comprising a roll bearing for supporting said crankshaft, of which inner and outer races are electrically connected to each other in operation.

15. A scroll compressor comprising:

an orbiting scroll having a wrap;

a stationary scroll having a wrap adapted to engage with the wrap of said orbiting scroll;

a crankshaft and an auxiliary crankshaft disposed on a side diametrically outside of the wraps of both said orbiting scroll and said stationary scroll and for driving said orbiting scroll;

a first pulley mounted on said crankshaft and a second pulley mounted on said auxiliary crankshaft; and a belt trained around outer peripheral sides of said first and second pulleys; and wherein said belt is electrically connected to said first and second pulleys.

16. A scroll compressor comprising:

an orbiting scroll having a wrap;

a stationary scroll having a wrap adapted to engage with the wrap of said orbiting scroll;

a crankshaft and an auxiliary crankshaft for driving said orbiting scroll and disposed on a side diametrically outside of the wraps of both said orbiting scroll and said stationary scroll;

a first pulley mounted on said crankshaft and a second pulley mounted on said auxiliary crankshaft; and a belt trained around outer peripheral sides of said first and second pulleys; and wherein electrical insulation is made between said crankshaft and said first pulley and between said auxiliary crankshaft and said second pulley.

17. An oil-free double toothed type scroll compressor comprising:

an orbiting scroll having spiral wraps on both sides of an end plate;

a pair of stationary scrolls having wraps adapted to engage with the wraps of said orbiting scroll;

a main crankshaft and an auxiliary crankshaft for rotationally driving said orbiting scroll, and disposed on a side diametrically outside of the wraps of both said orbiting scroll and said stationary scrolls;

a plurality of roll bearings for supporting said main crankshaft and said auxiliary crankshaft;

first and second pulleys mounted on said main crankshaft and auxiliary crankshaft, respectively;

a resin belt trained around said first and second pulleys;

resin tip seals held in grooves formed on tip ends of said orbiting scroll wraps and said stationary scroll wraps; and static electricity discharging means provided to discharge static electricity, which is produced in said timing belt portion and said tip seal portions, from said orbiting scroll to said stationary scrolls.

18. The scroll compressor according to claim 17, wherein said static electricity discharge means is a slip ring provided on an end of at least one of said main crankshaft and said auxiliary crankshaft.

19. The scroll compressor according to claim 17, wherein said static electricity discharge means comprises an electrically conductive grease for preventing the accumulation of static electricity in said roll bearings.

20. The scroll compressor according to claim 17, wherein said bearings comprise grease-lubricated bearings, and wherein a base oil of said grease is an ether-based synthetic oil and a thicker therefor is a urea compound.

* * * * *